US005816834A

United States Patent [19]

Nimura et al.

[11] Patent Number: 5,816,834

[45] Date of Patent: Oct. 6, 1998

[54] CONNECTOR ASSEMBLY CONTAINING A SHORT CIRCUIT TERMINAL

[75] Inventors: Kazuhiko Nimura; Hirotaka Makino, both of Yokkaichi; Kouichi Shirouzu; Kazuyuki Shiraki, both of Toyota, all of Japan

[73] Assignees: Sumitomo Wiring Systems, Ltd.; Toyota Jidosha Kabushiki Kaisha, both of Japan

[21] Appl. No.: 906,913

[22] Filed: Aug. 8, 1997

[30] Foreign Application Priority Data

Aug. 21, 1996 [JP] Japan ..... 8-220086

[51] Int. Cl.[6] ..... H01R 29/00

[52] U.S. Cl. ..... 439/188; 439/595; 200/51.1; 29/747

[58] Field of Search ..... 439/188, 752, 439/189; 200/51.1; 29/874, 876, 747

[56] References Cited

U.S. PATENT DOCUMENTS 5,263,872 11/1993 Marpoe, Jr. et al. ..... 439/188
5,562,486 10/1996 Saijo et al. ..... 439/188

FOREIGN PATENT DOCUMENTS 0822873 1/1996 Japan .

*Primary Examiner*—P. Austin Bradley
*Assistant Examiner*—T. C. Patel
*Attorney, Agent, or Firm*—Jordan B. Bierman; Bierman, Muserlian and Lucas

[57] ABSTRACT

A holding tool (40) is inserted into a retainer-attaching hole or a holding tool-accommodating space (22) with the holding tool (40) supporting a short-circuit terminal (15) therein. The short-circuit terminal (15) is inserted into a cavity (14) in a connector housing (10) by pushing a rear end of the terminal (15) through a handling aperture (23) by means of a pushing pin (45). Since the terminal (15) is inserted into the connector housing (10) from its lower side, a front opening of the cavity (14) can be formed into the smallest size so that a short-circuit-releasing member (31) can enter the opening (20). Extraneous substances hardly enter the cavity (14) in the connector housing (10) through the opening (20). Also, since the handling aperture (23) may be formed into the smallest size so that the pushing pin (45) can enter the aperture (23), the connector housing (10) becomes a small size. Thus, the connector housing (10) can be prevented from becoming a large-sized configuration and from entrance of the extraneous substances through the front opening (20) of the cavity (14).

3 Claims, 6 Drawing Sheets

CONNECTOR ASSEMBLY CONTAINING A SHORT CIRCUIT TERMINAL

BACKGROUND OF THE INVENTION

This invention relates to a method for attaching a short-circuit terminal to a connector and a connector assembly containing a short-circuit terminal.

Heretofore, in a connector to be used in an air bag circuit of an automotive vehicle, a connector to be used in an electronic circuit for a precisional machine, or the like, accident inflation of the air bag, breakage of the electronic circuit, or the like has been caused by the sudden occurrence of an electric potential difference between terminals in a connector.

In order to prevent such accidents, a short-circuit terminal is contained in a connector so that the short-circuit terminal normally short-circuits other terminals in the connector.

A conventional connector assembly containing a short-circuit terminal will be described below, for convenience of explanation, by referring to FIGS. 6 to 8. FIG. 6 is a longitudinal sectional view of a part of a conventional connector assembly containing a short-circuit terminal, illustrating the short-circuit terminal inserted in a short-circuit cavity in a connector housing. FIG. 7 is a longitudinal sectional view similar to FIG. 6, illustrating the short-circuit terminal which is released from short-circuiting the other terminals upon coupling to a mating connector. FIG. 8 is a longitudinal sectional view of a connector housing to be used in the conventional connector assembly containing the short-circuit terminal.

A connector assembly to be used in a circuit for an air bag includes, as shown in FIG. 6, one connector containing a short-circuit terminal in which a connector housing 1 is provided with a plurality of terminals 2 and a short-circuit terminal 3 adapted to short-circuit the plural terminals 3, and the other mating connector in which a connector housing 4 is provided with a tab 5 adapted to be fitted in one of the terminals 2 and a short-circuit releasing member 6 adapted to move into a space between the terminals 2 and the short-circuit terminal 3. When the connector housings 1 and 4 are separated from each other, the terminals 2 are short-circuited by the short-circuit terminal 3. When the connector housings 1 and 4 are interconnected so that the tab 5 is fitted in one of the terminals 2, the short-circuit releasing member 6 releases the terminals 2 from the short circuited state due to the short-circuit terminal 3, as shown in FIG. 7.

In such a connector containing a short-circuit terminal, the short-circuit terminal 3 is inserted into a cavity 7 in the connector housing 1 through an opening 8 formed in a front end of the cavity 7. This structure may permit any extraneous substances to enter the cavity 7 through the opening 8.

In order to overcome the above problem, as shown in FIG. 8, a connector housing 9A is provided with an insertion space 9D communicated to a rear end of a cavity 9C. A short-circuit terminal (not shown) is inserted into the insertion space 9D from a rear end surface of the connector housing 9A and is advanced across a retainer-attaching hole 9B to the cavity 9C. This structure will be able to prevent any extraneous substances from entering the cavity 9C through a front opening of the cavity since the opening can be formed in the smallest size through which the short-circuit releasing member can pass.

However, since a partition 9F between the insertion space 9D and a terminal accommodating chamber 9E above the space 9D has a great thickness in order to assure a strength of the connector housing 9A, a ceiling of the insertion space 9D is lower in height than that of the cavity 9C. Consequently, it is impossible to pass the short-circuit terminal through the insertion space 9D as it is. If the insertion space 9D has a higher ceiling, the connector housing 9A becomes a greater size by an increased height.

SUMMARY OF THE INVENTION

An object of the present invention is to provide a method for attaching a short-circuit terminal to a connector, which does not bring a connector housing into a large-sized configuration and prevents currents from leaking from an opening in a front side of a cavity in the connector housing.

Another object of the present invention is to provide a connector assembly containing a short-circuit terminal, which does not bring a connector housing into a large-sized configuration and prevents currents from leaking from an opening in a front side of a cavity in the connector housing.

In order to achieve the first object, a method for attaching a short-circuit terminal to a connector in accordance with the present invention comprises the steps of: supporting a short-circuit terminal in a holding tool, the short-circuit terminal being adapted to short-circuit another terminal disposed in a connector housing to each other; fitting the holding tool, which supports the short-circuit terminal, into a holding tool-accommodating space which passes from an outer periphery of the connector housing through a side wall of the housing to a short-circuit cavity for containing the short-circuit terminal in the housing; positioning the short-circuit terminal in a rear side of the cavity; inserting a pushing pin into a handling aperture which is open in a rear end surface of the connector housing and is communicated with the cavity; and pushing the short-circuit terminal out of the holding tool to a regular position in the cavity by means of the pushing pin.

The holding tool may be left in the holding tool-accommodating space as the tool is. Alternatively, a retainer may be fitted into the holding tool-accommodating space after the holding tool is removed from the space.

In order to achieve the second object of the present invention, a connector assembly containing at least one short-circuit terminal in accordance with the present invention comprises: a connector housing provided with a plurality of terminal-accommodating cavities; a plurality of terminals accommodated in the cavities; and at least one short-circuit terminal accommodated in at least one of the cavities.

At least one of the cavities in the connector housing is a short-circuit cavity which is adapted to receive the short-circuit terminal and is open in a front surface of the connector housing to permit a short-circuit-releasing member to enter the short-circuit cavity. The connector housing is provided with a holding tool-accommodating space formed from an outer periphery of the housing through a side wall to the short-circuit cavity and with a handling aperture which is axially alinged with the short-circuit cavity, is open in a rear surface of the housing, and is communicated with the short-circuit cavity through the holding tool-accommodating space. The short-circuit terminal is pushed into the short-circuit cavity by means of a holding tool and a pushing tool and is adapted to short-circuit the other terminals in the terminal cavities in the connector housing.

The holding tool is fitted in the holding tool-accommodating space with the short-circuit terminal is slidably received in the holding tool and wherein the pushing tool pushes the short-circuit terminal in the holding tool through the handling aperture from the rear surface of the connector housing so that the short-circuit terminal is displaced from the holding tool to the short-circuit cavity at the front side in the connector housing.

The holding tool is provided with a holding chamber which is communicated with the short-circuit cavity and handling aperture when the holding tool is fitted in a regular position in the holding tool-accommodating space. The holding chamber has a flat floor surface to be aligned with that of the short-circuit cavity and a slant ceiling surface which gradually increases a height from the front side to the rear side. A height of the slant ceiling surface at the half front side is set to be slightly lower than a height of a contact portion of the short-circuit terminal. The holding tool is provided on the bottom surface with an elongate handling portion which projects from the bottom surface of the connector housing when the holding tool is fitted in the space.

In the present invention, since the short-circuit terminal is attached to the connector by inserting the short-circuit into the connector housing through the opening in the outer side wall of the housing, a front opening of the cavity in the housing becomes the smallest size through which the short-circuit-releasing member can pass. Consequently, it is possible to prevent any extraneous substances from entering the cavity through the front opening of the cavity. Also, since the handling aperture which is open in the rear end surface of the connector housing may be of the smallest size through which the pushing tool can pass, it is possible to avoid an enlargement of the connector housing.

DETAILED DESCRIPTION OF THE PREFERRED EMBODIMENTS

Figure 1:
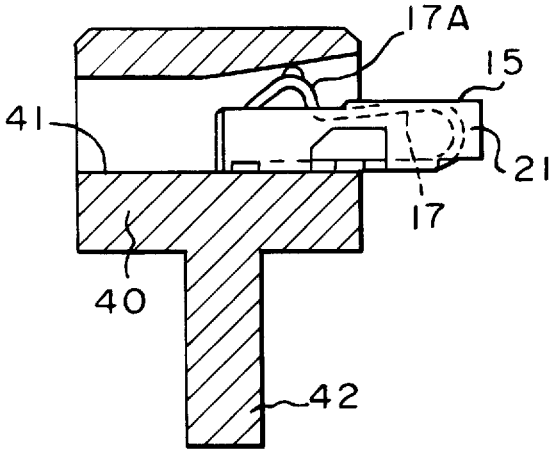
FIG. 1 is a longitudinal sectional view of a holding tool for a short-circuit terminal to be used in an attaching method of the present invention.

Referring now to the drawings, embodiments of a method for attaching a short-circuit terminal to a connector and a connector assembly containing a short-circuit terminal in accordance with the present invention will be described below.

First, an embodiment of a connector assembly containing a short-circuit terminal in accordance with the present invention will be explained by referring to FIGS. 1 to 5.

A connector housing 10 is provided with a plurality of terminal-containing cavities 11 in upper and lower rows. A terminal 12 (FIG. 4) is inserted into each cavity 11 from the rear surface of the connector housing 10 and retained in the cavity 11 by a lance 13. The cavities 11 are arranged in the width direction at the upper and lower rows in the connector housing 10. Two terminals 12, 12 contained in two adjacent cavities 11, 11 are short-circuited by a short-circuit terminal 15 contained in a short-circuit cavity 14 below the cavities 11, 11.

The short-circuit cavity 14 adapted to contain the short-circuit terminal 15 has a width across two terminal cavities 11, 11 adapted to contain another terminals 12 being short-circuited and disposed above the cavity 14 and has a length over a front half side of the cavity 11.

Figure 4:
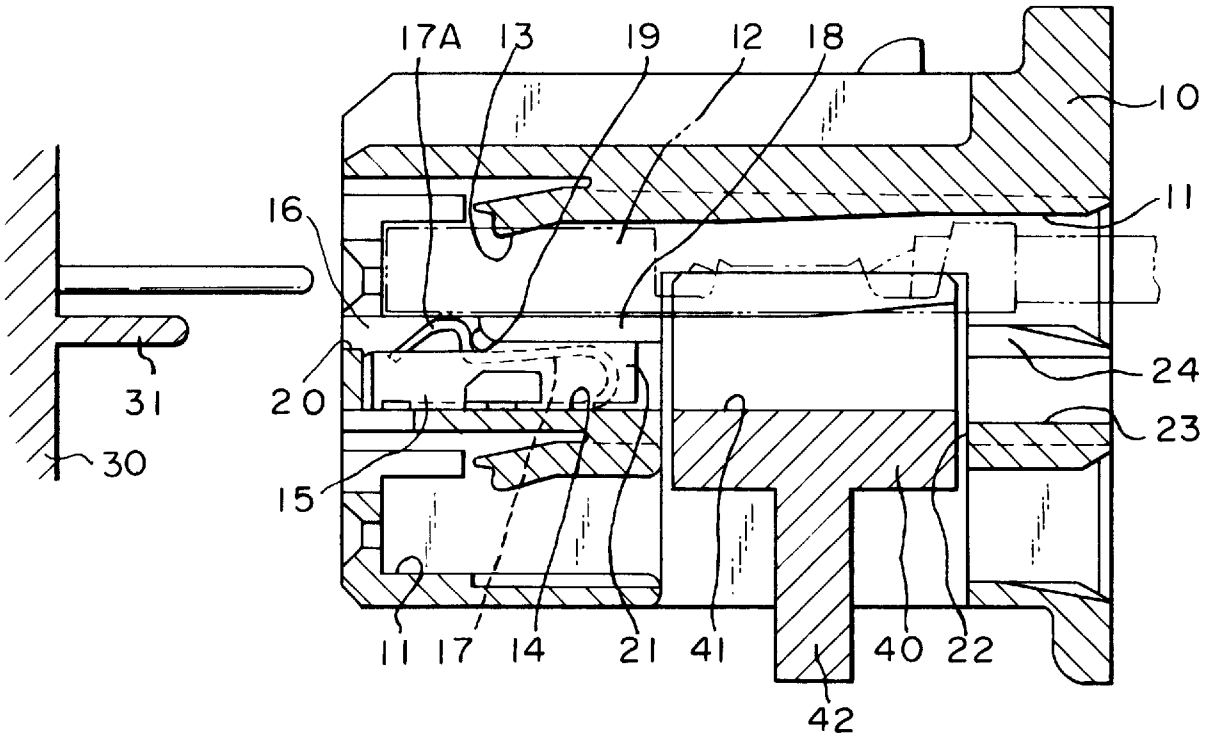
FIG. 4 is a longitudinal sectional view similar to FIG. 2, illustrating the short-circuit terminal which has been inserted into the cavity.

An upper front half side of the cavity 14 is communicated with two upper terminal cavities 11, 11. When the mating connector housing 30 is not fitted in the connector housing 10, a pair of resilient contact pieces 17, 17 of the short-circuit terminal 15 come into contact with the adjacent terminals 12, 12 respectively in a communication portion 16, as shown in FIG. 4, thereby short-circuiting the adjacent terminals 12, 12. On the other hand, an upper rear half side of the cavity 14 is a ceiling portion 18 which is lower than the highest contact portion 17A of the short-circuit terminal 15. A front end of the ceiling portion 18 serves as a lock part 19 adapted to lock the contact portion 17A.

Figure 5:
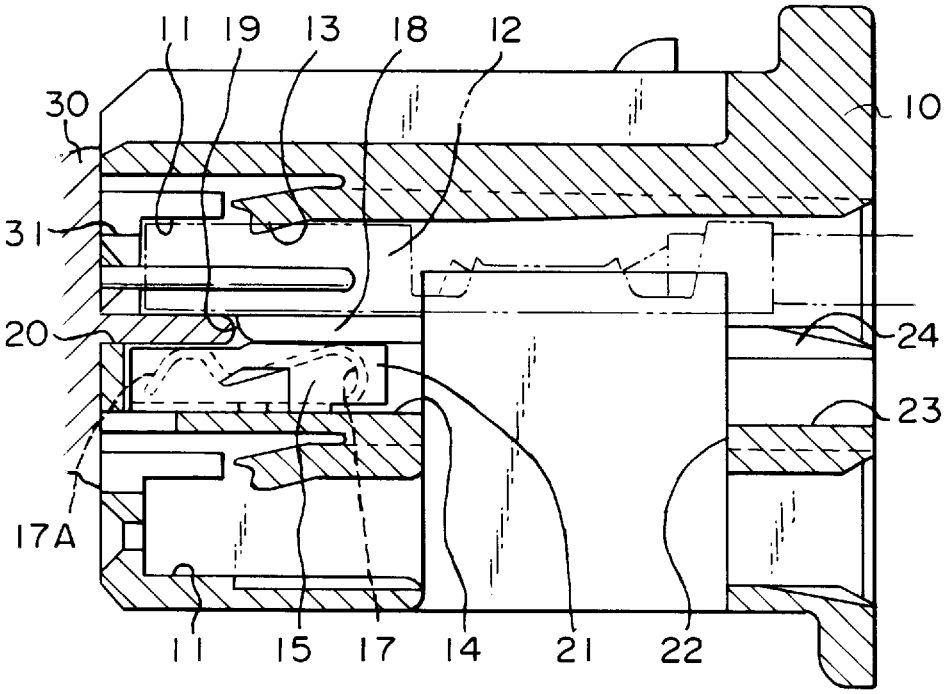
FIG. 5 is a longitudinal sectional view similar to FIG. 4, illustrating the short-circuit terminal which is released from short-circuiting another terminals upon coupling to a mating connector.
Figure 6:
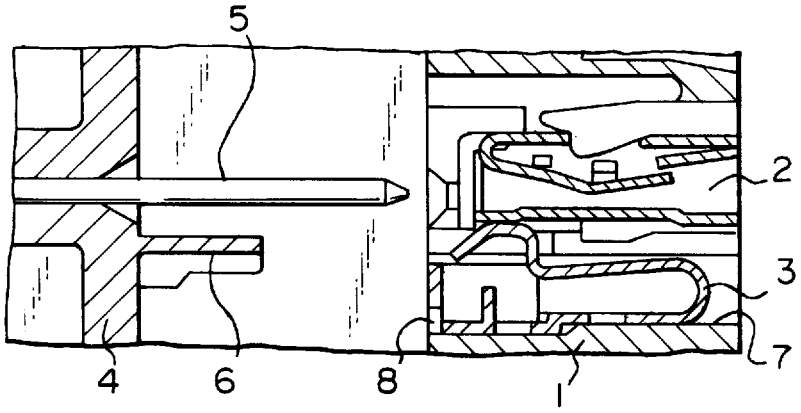
Fig. 6 PRIOR ART
FIG. 6 is a longitudinal sectional view of a part of a conventional connector assembly containing a short-circuit terminal, illustrating the short-circuit terminal inserted in a short-circuit cavity in a connector housing.
Figure 7:
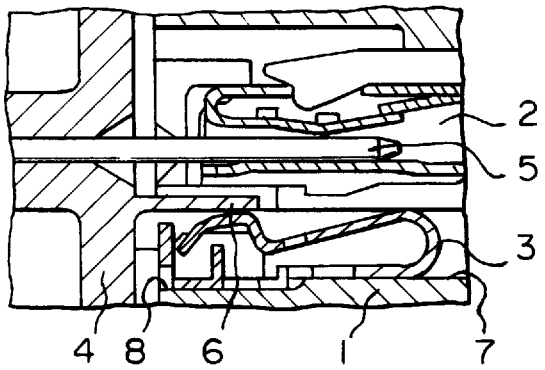
Fig. 7 PRIOR ART
FIG. 7 is a longitudinal sectional view similar to FIG. 6, illustrating the short-circuit terminal which is released from short-circuiting the other terminals upon coupling to a mating connector.
Figure 8:
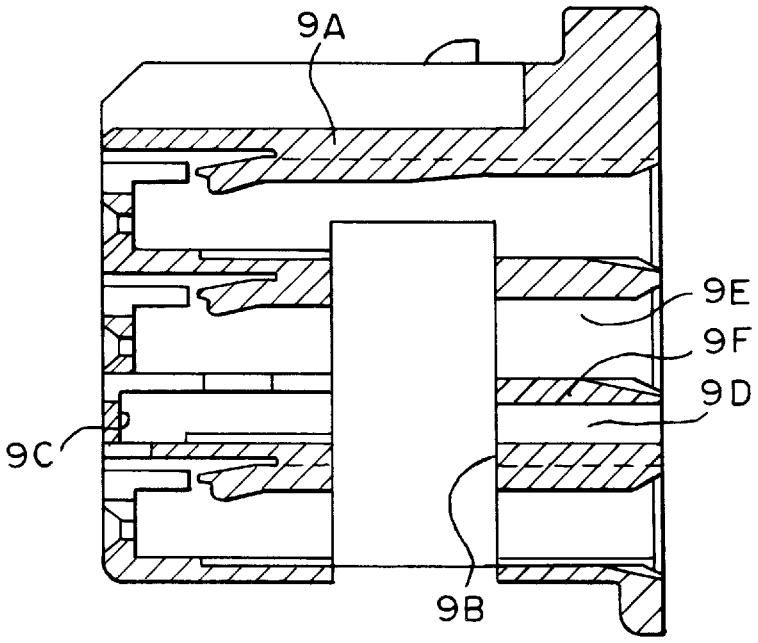
Fig. 8 PRIOR ART
FIG. 8 is a longitudinal sectional view of a connector housing to be used in the conventional connector assembly containing the short-circuit terminal.
Figure 9:
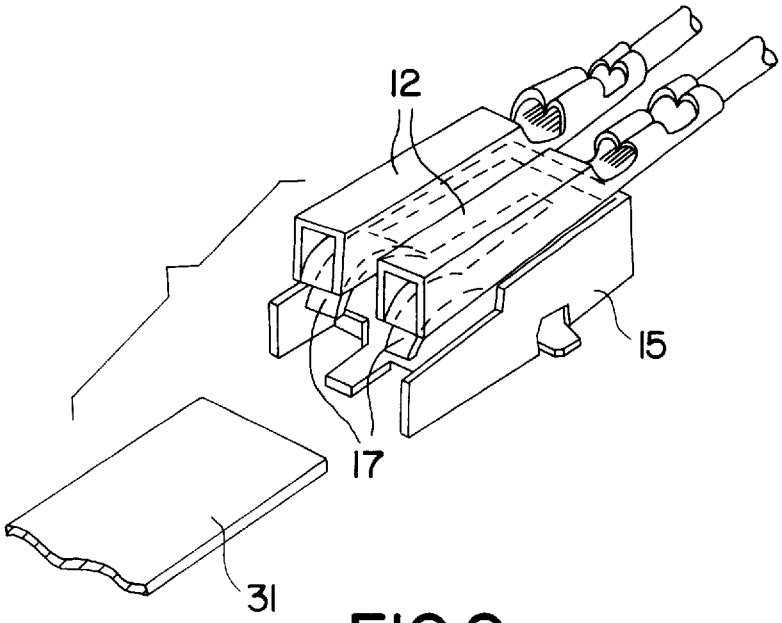
FIG. 9 is a perspective view of two terminals arranged side by side.
Figure 10:
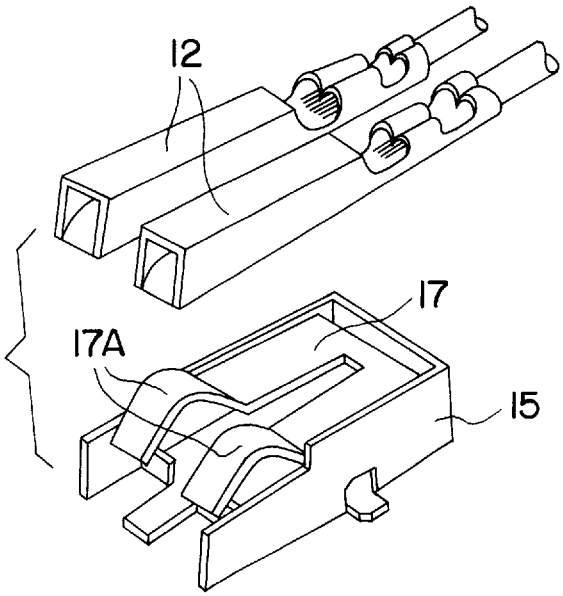
FIG. 10 is a exploded view similar to FIG. 9.

The cavity 14 is provided on its front end with an opening 20 which communicates with a front end of the connector housing 10. The opening 20 is formed into the smallest size through which a short-circuit-releasing member 31 of the mating connector 30 passes along the upper part of the cavity 14. When the mating connector housing 30 is fitted in the connector housing 10, the short-circuit-releasing member 31 enters the cavity 14 through the opening 20 so that the member 31 squeezes itself between the short-circuit terminal 15 and the terminals 12, thereby releasing the short-circuited position between the terminals 15 and 12, as shown in FIG. 5.

The short-circuit terminal 15 will be explained below. The short-circuit terminal 15 includes opposite side walls 21 extending along side edges and rear edges and a pair of resilient contact pieces 17 extending in a cantilever manner from a rear side to a front side. Each resilient contact piece 17 is provided on its front end with a contact part 17A bent upwardly in a dome shape. When the contact part 17A enters the upper terminal cavity 11, the contact part 17A is brought into resilient contact with a bottom surface of the terminal 12. When the short-circuit-releasing member 31 thrusts itself between the terminals 15 and 12 while elastically deflecting the resilient contact pieces 17 downward, the resilient contact pieces 17 are separated from the terminals 12, 12.

The connector housing 10 is provided with a retainer-attaching hole or a holding tool-accommodating space 22 which is open the bottom surface of the housing 10, extends across the lower terminal cavity 11, and communicates with the rear end of the cavity 14 and a lower part of the upper terminal cavity 11. A holding tool 40 which is used to dispose the short-circuit terminal 15 in the cavity 14, as mentioned hereinafter, is designed to be inserted in the retainer-attaching hole 22. After disposing the short-circuit terminal 15 in the cavity 14, a retainer (not shown) may be inserted in the hole 22 in order to retain the terminals 12 in the terminal cavities 11.

A handling aperture 23 is formed in the connector housing 10. The handling aperture 23 is open in the rear end surface of the housing 10 and in the rear side inner wall of the retainer-attaching hole 22 and is disposed at the same level as the cavity 14. The handling aperture 23 is adapted to receive a pushing pin 45 mentioned below which serves to forwardly push the short-circuit terminal 15 in the holding tool 40. The height of the handling aperture 23 is smaller than the height of the cavity 14, namely the height of the short-circuit terminal 15. This makes a partition 24 between the handling aperture 23 and the upper terminal cavities 11 thick, thereby ensuring a high strength of the partition 24.

The holding tool 40 can be inserted into the retainer-attaching hole 22 with no play. The holding tool 40 has a holding chamber 41 which is communicated with the cavity 14 and the handling aperture 23 when the tool 40 is inserted in the aperture 23. The holding chamber 41 has a flat floor surface which is disposed at the same level as the lower part of the cavity 14. The holding chamber 41 also has a ceiling surface a front half side of which is slightly lower than the contact part 17A of the short-circuit terminal 15. On the other hand, the rear half side of the ceiling surface is slanted upwardly from a front side to a rear side. In addition, the holding tool 40 is provided on the bottom surface with an elongate handling rod 42 which projects out of the bottom surface of the connector housing 10.

Next, an embodiment of a method for attaching a short-circuit terminal to the connector described above will be explained below.

In a process of attaching the short-circuit terminal 15 to the cavity 14, first, the short-circuit terminal 15 is inserted into the holding chamber 41 in the holding tool 40 from the rear side, as shown in FIG. 1. Then, the resilient contact piece 17 elastically comes into contact with the ceiling surface of the holding chamber 41 and the short-circuit terminal 15 is retained in the holding chamber 41 by a frictional force without causing any plays. In this retaining state, the short-circuit terminal 15 can slide axially under a force more than a given value.

Figure 2:
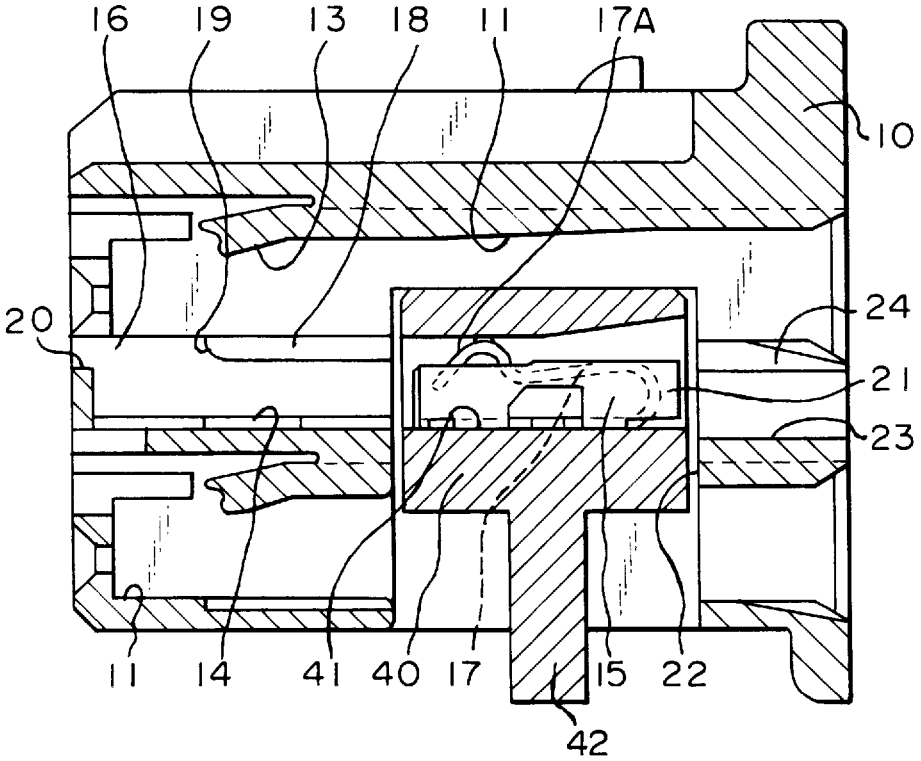
FIG. 2 is a longitudinal sectional view of a connector assembly of the present invention, illustrating the holding tool fitted in a retainer-attaching hole in a connector housing with the short-circuit terminal being contained in the holding tool.
Figure 3:
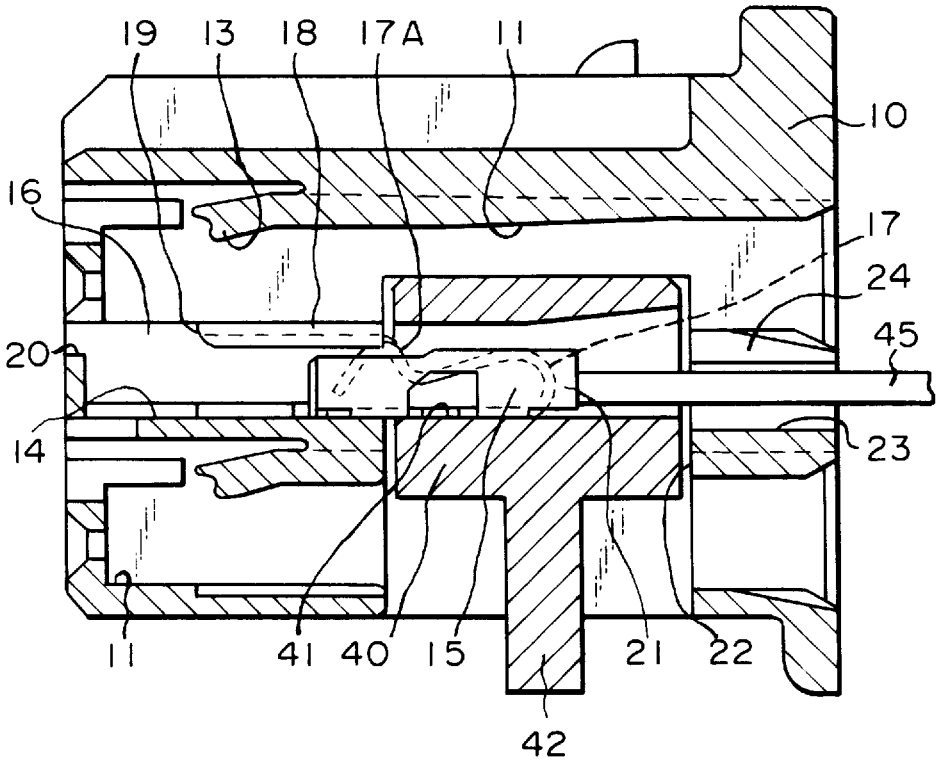
FIG. 3 is a longitudinal sectional view similar to FIG. 2, illustrating the short-circuit terminal being inserted into a short-circuit cavity in the connector housing.

Secondly, as shown in FIG. 2, the holding tool 40 containing the short-circuit terminal 15 is inserted into the retainer-attaching hole 22 in the connector housing 10. The handling rod 42 facilitates the insertion of the holding tool 40 into the hole 22. In this fitting position, the holding chamber 41 is axially aligned with the cavity 14 so that the short-circuit terminal 15 can enter the cavity 14. When the pushing pin 45 is inserted into the handling aperture 23 in the connector housing 10 from the rear side of the housing, as shown in FIG. 3, the pushing pin 45 engages with the walls 21 of the short-circuit terminal 15 at the distal end and pushes the terminal 15 into the cavity 14 from the rear side to the front side.

When the short-circuit terminal 15 is being inserted into the cavity 14, the resilient contact pieces 17 slide on the ceiling surface 18 of the cavity 14 while being deflected elastically. When the short-circuit terminal 15 reaches a regular insertion position in the cavity 14, the resilient contact pieces 17 pass the ceiling surface 18 and return to the original posture to be locked on the lock portion 19. After inserting the short-circuit terminal 15 into the cavity 14, the pushing pin 45 is drawn out of the handling aperture 23 and the holding tool 40 is detached from the connector housing 10. The handling rod 42 facilitates the detachment of the holding tool 40 from the housing 10. The process of attaching the short-circuit terminal 15 to the cavity 14 is completed by the above steps. Thereafter, the terminals 12 are inserted into the terminal cavities 11 and the retainer (not shown) is attached to the retainer attaching hole 22.

In the above embodiment, since the short-circuit terminal 15 is not directly inserted into the cavity 14 through the opening 20 in the front surface of the connector housing 10 but indirectly inserted into the cavity 14 through the holding chamber 41 in the holding tool 40 after attaching the holding tool 40 to the hole 22, the inlet opening of the cavity 14 in the front surface of the connector housing 10 can be formed into the smallest size through which the short-circuit-releasing member 31 can pass. Thus, any extraneous substances hardly enter the cavity 14 through the front opening 20.

Since the short-circuit terminal 15 is inserted into the cavity 14 through the holding chamber 41 in the holding tool 40 inserted in the hole 22 in the connector housing 10, it is unnecessary to enlarge a diameter of the handling aperture 23 in order to permit the terminal 15 to pass through the aperture 23. Thus, the handling aperture 23 has a size enough to receive the pushing pin 45. Accordingly, it is possible to make the connector housing 10 more compact in comparison with the conventional connector housing in which the short-circuit terminal is inserted from the rear end side.

In addition, in the embodiment of the present invention, since the ceiling surface of the holding chamber 41 in the holding tool 40 is slanted downward from the rear side to the front side, the operation of inserting the short-circuit terminal 15 into the chamber 41 becomes easy.

A holding tool-receiving space may be formed in the connector housing in addition to the retainer-attaching hole, although the retainer-attaching hole is utilized as a holding tool-accommodating space in the above embodiment. In this case, after attaching the short-circuit terminal to the housing, the holding tool may be left in the holding tool-receiving space as it is without drawing it out of the space.

The entire disclosure of Japanese Patent Application No. 8-220086 filed on Aug. 21, 1996 including specification, claims, drawings and summary is incorporated herein by reference in its entirety.

What is claimed is:

1. A connector assembly containing at least one short-circuit terminal, comprising:

a connector housing provided with a plurality of terminal-accommodating cavities;

a plurality of terminals accommodated in said cavities; and at least one short-circuit terminal accommodated in at least one of said cavities;

at least one of said cavities in said connector housing being a short-circuit cavity receiving said short circuit terminal for short circuiting two of said terminals, disposed in adjacent cavities and is open in a front surface of said connector housing to permit a short-circuit-releasing member to enter said short-circuit cavity;

said connector housing being provided with a holding tool-accommodating space formed from an outer periphery of said housing through a side wall to said short-circuit cavity and with a handling aperture which is axially aligned with said short-circuit cavity, said handling aperture being open in a rear surface of said housing and in communication with said short-circuit cavity through said holding tool-accommodating space;

said short-circuit terminal being pushed into said short-circuit cavity by means of a holding tool and a pushing tool and short-circuits the terminals disposed in adjacent terminal cavities in said connector housing.

2. A connector assembly according to claim 1, wherein said holding tool is fitted in said holding tool-accommodating space with said short-circuit terminal being slidably received in said holding tool and wherein said pushing tool pushes said short-circuit terminal in said holding tool through said handling aperture from the rear surface of said connector housing so that said short-circuit terminal is displaced from said holding tool to said short-circuit at the front side in said connector housing.

3. A connector assembly according to claim 1, wherein said holding tool is provided with a holding chamber which is in communication with said short-circuit cavity and said handling aperture when said holding tool is fitted in a regular position in said holding tool-accommodating space, said holding chamber has a flat floor surface to be aligned with that of said short-circuit cavity and a slant ceiling surface which gradually increases in height from the front side to the rear side, the height of said slant ceiling surface at the front side being slightly lower than a height of a contact portion of said short-circuit terminal, and wherein said holding tool is provided on the bottom surface with an elongate handling portion which projects from the bottom surface of said connector housing when said holding tool is fitted in said space.

* * * * *